US005938814A

United States Patent [19]

Uenosono et al.

[11] Patent Number: 5,938,814

[45] Date of Patent: Aug. 17, 1999

[54] IRON BASED POWDER MIXTURE FOR POWDER METALLURGY

[75] Inventors: Satoshi Uenosono; Kuniaki Ogura, both of Chiba; Jibin Yang, Niigata, all of Japan

[73] Assignee: Kawasaki Steel Corporation, Japan

[21] Appl. No.: 09/028,899

[22] Filed: Feb. 24, 1998

[30] Foreign Application Priority Data

| | | | |
|---|---|---|---|
| Feb. 25, 1997 | [JP] | Japan | 9-040351 |
| Mar. 28, 1997 | [JP] | Japan | 9-076940 |
| Dec. 10, 1997 | [JP] | Japan | 9-339892 |

[51] Int. Cl.[6] ..... B22F 1/00

[52] U.S. Cl. ..... 75/254; 75/231; 75/243; 75/244; 75/246

[58] Field of Search ..... 75/252, 254, 231, 75/243, 244, 246

[56] References Cited

U.S. PATENT DOCUMENTS

| | | | |
|---|---|---|---|
| 3,132,021 | 5/1964 | Koehring . | |
| 3,725,142 | 4/1973 | Huseby | 148/16 |
| 4,098,608 | 7/1978 | Matty et al. | 75/252 |
| 4,204,031 | 5/1980 | Takemura et al. | 428/539.5 |
| 4,437,890 | 3/1984 | Hayasaka et al. | 75/244 |
| 4,491,477 | 1/1985 | Suganuma et al. | 75/230 |
| 4,891,080 | 1/1990 | Del Corso et al. | 149/326 |
| 5,462,573 | 10/1995 | Baker et al. | 75/231 |
| 5,522,914 | 6/1996 | Stasko et al. | 75/231 |

*Primary Examiner*—Ngoclan Mai
*Attorney, Agent, or Firm*—Austin R. Miller

[57] ABSTRACT

An iron based powder mixture for powder metallurgy is provided which can produce a sintered material having by far higher machinability and sliding properties than conventional sintered materials, and also a sintered material containing alloy elements but having adaptability to sizing even after sintering; it comprises an atomized iron powder comprising S in a content of 0.03 to 0.30 wt %, Mn in a content of 0.05 to 0.40 wt % and the balance Fe and incidental impurities, to which is added one or more than one B-containing compound powder selected from boron nitride (BN), boric acid ($H_3BO_3$), boron oxide ($B_2O_3$) and the like in an amount of 0.001 to 0.3 wt % expressed as B, and incorporated with an MnS powder in an amount of 0.05 to 1.0 wt %, optionally alloyed partially with or prealloyed with Ni, Mo and Cu.

15 Claims, 3 Drawing Sheets

IRON BASED POWDER MIXTURE FOR POWDER METALLURGY

BACKGROUND OF THE INVENTION

1. Field of the Invention

This invention relates to iron based powder mixtures for powder metallurgy. More particularly, the invention relates to iron based powder mixtures which produce a sintered material excelling in machinability and sliding property, and also provide a sintered material containing Ni, Mo, Cu and the like but having adaptability to sizing even after sintering.

2. Description of the Related Art

In general, powder metallurgy is referred to as a technology in which metallic powder is subjected to pressing in a mold, followed by sintering of the resulting green compact, thereby producing a shape such as a machine part or the like. For instance, iron powder when employed as a metallic powder may be intermixed with Cu powder, graphite powder and the like and then pressed, and sintered to form a sintered material usually having a density on the order of 5.0 to 7.2 g/cm$^3$. This powder metallurgy technique is capable of producing a machine part of complicated shape with good dimensional accuracy. In order to form a machine part with even more precise dimensional accuracy, however, such sintered material needs in some instances to be further shaped as by machining, drilling or the like.

Sintered material generally has poor machinability and hence causes a short tool life of a machine tool used for machining it, as compared to a wrought steel for example, resulting from rolling of a cast piece produced by continuous casting. Such machining requires added cost.

Poor machinability peculiar to sintered materials is attributable to pores that are present. The pores cause the sintered material to be only discontinuously machined, or reduce the heat conductivity of such sintered material and hence increase the temperature of the portions of the sintered material where it is machined.

Many attempts have heretofore been made to attain improved machinability of the sintered material. These include admixing iron powder with S or MnS. The reason for use of S or MnS is that such material can render machined scrap easily breakable, or can form a thin film of S or MnS on the rake face of a machine tool used. Such a thin film can exert lubricating action during machining of the sintered material.

Japanese Examined Patent Publication No. 3-25481, for example, discloses an iron powder for powder metallurgy which results from atomization of a molten steel with water or gas. The molten steel is composed of pure iron mixed with Mn at a content of 0.1 to 0.5 wt %, and with S, C and the like, and further with S at a content of 0.03 to 0.07 wt %. However, a sintered material produced from this iron powder can improve its machinability by only about twice the corresponding sintered material obtained from an iron powder in common use. Accordingly, a need continues for further improvement.

Moreover, Japanese Unexamined Patent Publications Nos. 7-233401 and 7-233402 teach atomized steel powders each containing S, Cr and Mn. According to the teachings of the two prior publications, a sintered material derived from each such steel powder shows sharp improvement of machinability because graphite remains in the pores of the material, and MnS simultaneously deposits in the iron particles. The reason graphite so remains is presumably because Cr and S prevent graphite from diffusion into the iron particles during sintering of the steel powder.

The resulting steel powder, however, has the defect that sintering in an atmosphere containing $H_2$ leads to a sintered material having reduced machinability and wear resistance properties. Further improvement has been strongly desired.

Additionally, Japanese Unexamined Patent Publication No. 8-176604 discloses that improved machinability can be gained with an increased amount of graphite by sintering an iron powder comprising boron at a content of 0.001 to 0.03 wt %, Cr in a content of 0.02 to 0.07 wt %, Mn in a content of less than 0.1 wt % and one or more of S, Se and Te in a total content of 0.03 to 0.15 wt %. The technology of this publication allows graphite to remain in the sintered material, but in an amount of approximately 0.42 wt % at the most. A demand has thus been voiced for the development of an iron powder that ensures a larger amount of graphite remaining in the sintered material.

On the other hand, in the production of gears for use as automotive parts by means of powder metallurgy, which gears require high strength and high wear resistance properties, certain alloy elements are commonly added to enhance these properties. For example, Japanese Examined Patent Publication No. 45-9649 discloses adding alloy components such as Ni, Cu and Mo to a pure iron powder through partial diffusion alloying. The steel powder derivable from this production method can produce a green compact having excellent compressibility and sintered steel having strength. However, the resulting sintered material is disadvantageous in that it is excessively hard and is almost completely unadaptable to sizing after sintering, and has poor machinability.

SUMMARY OF THE INVENTION

Overcoming the foregoing problems of the prior art, the present invention provides as its principal object a powder mixture for powder metallurgy which can produce a sintered material that is by far superior in regard to machinability and sliding property than conventional sintered materials. The invention also relates to a sintered material containing alloy elements, which material is highly strong, adequately adjustable as to sizing(size correction) after sintering, and efficiently and effectively machinable and slidable.

In contrast to Japanese Unexamined Patent Publication No. 8-176604 cited above, we have created a novel sintered material having important improvements of machinability and sliding properties. We have unexpectedly found that, with iron powder containing S, nearly 100% of the B in a B-containing iron powder can be segregated as boric acid on the surface of such iron powder, as determined by Auger analysis of B on the surface of iron powder. We made an iron powder containing S in a certain specific amount, mixed with one or more boron compounds, such as powdered boric acid or powdered h-BN, and containing powdered graphite and a lubricant, which mixture is moldable and capable of sintering into a remarkable sintered material. We found that our sintered material thus formed created an unexpectedly increased amount of free graphite than a sintered material made by sintering a green compact composed of a B-containing iron powder, graphite powder and a lubricant. Still another finding of ours is that graphite remaining in an amount more than 1 wt % leads to a noticeable enhancement in sliding properties, and that MnS added in a content of 0.05 to 1.0 wt % contributed to further improvement of machinability.

We also found that the properties discussed above can be further enhanced by causing a B-containing compound to adhere to the surface of a selected iron powder through segregation-free treatment.

The present invention has created an iron based powder mixture for powder metallurgy comprising an iron powder having S in a content of about 0.03 to 0.30 wt %, one or more than one B-containing compound powder, and a graphite powder, or a graphite powder and a lubricant, wherein the B-containing compound powder is mixed in an amount of about 0.001 to 0.3 wt %, expressed as B, based on the sum of all of the iron powder, the B-containing compound powder and the graphite powder.

In this invention, the iron powder specified above may be preferably in the form of an atomized iron powder comprising S in a content of about 0.03 to 0.30 wt % and Mn in a content of about 0.05 to 0.40 wt %, and the balance Fe and incidental impurities. Alternatively, the specified iron powder may be in the form of an atomized iron powder comprising S in a content of about 0.03 to 0.30 wt %, Mn in a content of about 0.05 to 0.40 wt % and one or both metals selected from Ni in a content of about 0.5 to 7.0 wt % and Mo in a content of about 0.05 to 6.0 wt %, and the balance Fe and incidental impurities. Furthermore, the specified iron powder may be derived by use of one or more metals selected from Ni in a content of about 0.5 to 7.0 wt %, Cu in a content of about 0.5 to 7.0 wt % and Mo in a content of about 0.05 to 3.5 wt %, and partially alloyed relative to an atomized iron powder comprised of S in a content of about 0.03 to 0.30 wt % and Mn in a content of about 0.05 to 0.40 wt %, and the balance Fe and incidental impurities. The specified iron powder may also be obtainable by adhesion of the above-mentioned B-containing compound powder to the surface of the former powder.

The present invention further provides an iron based powder mixture for powder metallurgy comprising an iron powder having S in a content of about 0.03 to 0.30 wt %, one or more than one B-containing compound powder, a copper powder and a graphite powder, or a graphite powder and a lubricant, wherein the B-containing compound powder is present in an amount of about 0.001 to 0.3 wt % expressed as B and the copper powder in an amount of not more than about 4 wt %, respectively, with respect to the amounts of all of the iron powder, the B-containing compound powder, the copper powder and the graphite powder. In this invention, the iron powder specified is preferably an atomized iron powder comprised of S about 0.03 to 0.30 wt % and Mn about 0.05 to 0.40 wt %, and the balance Fe and incidental impurities. Alternatively, the specified iron powder may be obtainable by adhesion of the above-identified B-containing compound powder to the surface of the former powder.

The present invention further provides an iron based powder mixture for powder metallurgy comprising an iron powder having S in a content of about 0.03 to 0.30 wt %, one or more than one B-containing compound powder, a MnS powder, a graphite powder, or a graphite powder and a lubricant, wherein the B-containing compound powder is mixed in an amount of about 0.001 to 0.3 wt % expressed as B, and wherein the MnS powder is mixed in an amount of about 0.05 to 1.0 wt %, respectively, with respect to the total of all of the iron powder, the B-containing compound powder, the MnS powder and the graphite powder. The iron powder specified is preferably in the form of an atomized iron powder comprising S in a content of about 0.03 to 0.30 wt % and Mn in a content of about 0.05 to 0.40 wt %, and the balance Fe and incidental impurities. Alternatively, such specified iron powder may be in the form of an atomized iron powder comprising S in a content of about 0.03 to 0.30 wt %, Mn in a content of about 0.05 to 0.40 wt %, and one or both metals selected from Ni in a content of about 0.5 to 7.0 wt % and Mo in a content of about 0.05 to 6.0 wt % and the balance Fe and incidental impurities. Additionally and alternatively, the specified iron powder may be derived by use of one or more metals selected from Ni in a content of about 0.5 to 7.0 wt %, Cu in a content of about 0.5 to 7.0 wt % and Mo in a content of about 0.05 to 3.5 wt % and partially alloyed relative to an atomized iron powder comprising S in a content of about 0.03 to 0.30 wt % and Mn in a content of about 0.05 to 0.40 wt %, and the balance Fe and incidental impurities. The specified iron powder is also obtainable by adhesion of the above B-containing compound powder to the surface of the former powder.

The present invention further provides an iron based powder mixture for powder metallurgy comprising an iron powder comprising S in a content of about 0.03 to 0.30 wt %, one or more than one B-containing compound powder, MnS powder, a copper powder, a graphite powder, or a graphite powder and a lubricant, wherein the B-containing compound powder is mixed in an amount of about 0.001 to 0.3 wt % expressed as B, the MnS powder in an amount of about 0.05 to 1.0 wt % and the copper powder in an amount of about 4 wt % or below, respectively, with respect to the total amounts of all of the iron powder, the B-containing compound powder, the MnS powder, the copper powder and the graphite powder. The iron powder specified may be preferably in the form of an atomized iron powder comprising S in a content of about 0.03 to 0.30 wt % and Mn in a content of about 0.05 to 0.40 wt % and as the balance Fe and incidental impurities. Alternatively, the specified iron powder may be obtained by adhesion of the above B-containing compound powder to the surface of the former powder.

In addition, the present invention provides a process for producing a sintered material comprising mixing an iron powder comprising S in a content of about 0.03 to 0.30 wt % with one or more than one B-containing compound powder, a graphite powder, or a graphite powder and a lubricant, and where desired a copper powder, thereby preparing a powder mixture, press molding the powder mixture to form a green compact, and subsequently sintering the green compact, wherein one or more than one B-containing compound powder is mixed in an amount of about 0.001 to 0.30 wt % in terms of B with respect to the total amounts of all of the iron powder, the B-containing compound powder, the graphite powder and the copper powder.

In this invention, in a process for producing a sintered material comprising a step of mixing an iron powder comprising S in a content of about 0.03 to 0.30 wt % with a B-containing compound powder, a graphite powder, a lubricant and where desired a copper powder, thereby preparing a powder mixture, press molding the powder mixture to form a green compact, and subsequently sintering the green compact, wherein one or more than one B-containing compound powder is mixed in an amount of about 0.001 to 0.30 wt % expressed as B with respect to the total amounts of all of the iron powder, the B-containing compound powder, the graphite powder and the copper powder, the step of preparing the powder mixture may comprise mixing the iron powder with a liquid fatty acid at room temperature, adding and mixing the B-containing compound powder, the graphite powder and where desired a copper powder and a metallic soap to and with the resulting powder mixture, forming and mixing a eutectic mixture of the fatty acid and the metallic soap with a rise in temperature during or after the B-containing mixing step, and adding and mixing a fatty acid or a wax on cooling after the eutectic step.

When it is found desirable, the B-containing compound and graphite powder admixture step may be replaced by a step mixing iron-fatty acid powder with the B-containing compound powder and the metallic soap, and the fatty acid or wax mixing step may be replaced by a step in which the graphite powder and, where desired, the copper powder and the metallic soap or the wax are added and mixed during cooling after the eutectic formation.

Alternatively, the step of preparing the powder mixture may comprise mixing the iron powder with the B-containing compound powder,the graphite powder, and, where desired the copper powder, and two or more waxes of different melting points, forming and mixing a partial melt of the waxes with a rise in temperature during or after the iron powder mixing, and the step of cooling and then solidifying the partial melt, causing at least the B-containing compound powder to adhere to the iron powder on its particles, and subsequently adding and mixing a metallic soap and/or a wax during cooling. According to this invention, the iron powder mixing step may be replaced by a step in which the iron powder is incorporated with and mixed with the B-containing compound powder and the two or more waxes of different melting points, and the performance of the eutectic step may be replaced by a step in which the graphite powder and, where desired, the copper powder and the metallic soap or the wax are added and mixed during cooling.

The present invention further provides a process for producing a sintered material comprising mixing an iron powder having S in a content of about 0.03 to 0.30 wt % with one or more than one B-containing compound powder, an MnS powder, a graphite powder, or a graphite and a lubricant, and where desired a copper powder, thereby preparing a powder mixture, press molding the powder mixture to form a green compact, and subsequently sintering the green compact, wherein the one or more than one B-containing compound powder is mixed in an amount of about 0.001 to 0.30 wt %, expressed as B, and the MnS powder in an amount of about 0.05 to 1.0 wt %, respectively, with respect to the total amounts of all of the iron powder, the one or more than one B-containing compound powder, the MnS powder, the graphite powder and the copper powder.

In this invention, in a process for producing a sintered material comprising a step of mixing an iron powder comprising S in a content of about 0.03 to 0.30 wt % with more than one B-containing compound powder, a MnS powder, a graphite powder and, where desired, a copper powder, thereby preparing a powder mixture, adding and mixing a lubricant to and with the powder mixture, press molding the resulting powder mixture to form a green compact, and subsequently sintering the green compact, wherein the one or more than one B-containing compound powder is mixed in an amount of about 0.001 to 0.30 wt % (expressed as B) and the MnS powder in an amount of about 0.05 to 1.0 wt %. The step of preparing the powder mixture may comprise mixing the iron powder with a liquid fatty acid at room temperature, adding and mixing the B-containing compound powder, the graphite powder and, where desired, a copper powder and a metallic soap to and with the resulting first powder mixture, forming and mixing a eutectic mixture of the fatty acid and the metallic soap with a rise in temperature during or after the second mixing step, and adding and mixing a fatty acid or a wax during cooling after the eutectic mixture step.

The appended drawings illustrate important features of the invention. They are specific embodiments selected as illustrative, and are not intended to define or to limit the scope of the invention as defined in the appended claims.

DESCRTPTTON OF THE PREFERRED EMBODIMENTS

Figure 1A:
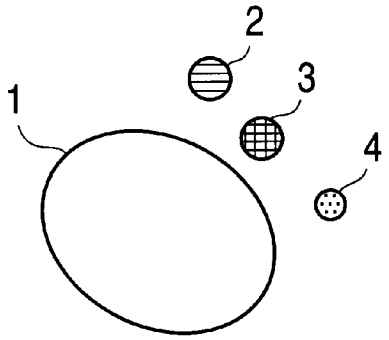
FIG. 1A is a schematic view showing a powder mixture obtained by mixing.

The iron based powder mixture of the present invention comprises an S-containing iron powder, one or more than one B-containing compound powder, a graphite powder, or a graphite powder and a lubricant, and a copper powder where desired. This iron based powder mixture can further contain an MnS powder.

With regard to the sintered material derived from the powder mixture according to this invention, we believe that free graphite can easily be formed by interaction of S contained in the iron powder, or such inclusions as MnS, FeS and the like contained in the iron powder, with B contained in the B-containing compound powder. Although the mechanism is not exactly known, such thought is supported by the fact that no formation of free graphite can be detected in a sintered material resulting from mixing a pure iron powder having a low content of S (S=0.02 wt % or so) with one or more than one B-containing compound. With the content of S in the iron powder strictly observed as specified by the present invention, free graphite can easily be formed even when Ni, Cu, Mo and the like are added to the iron powder by partial alloying or Ni and Mo are added to an iron powder by prealloying. This free graphite serves to enhance the machinability of the resulting sintered material and to improve the sliding properties of the sintered material through self-lubrication by the graphite.

To further improve machinability and sliding properties of the sintered material, the present invention attaches importance to producing a sintered material by mixing an iron powder containing S in a specified amount with one or more than one B-containing compound powder, a graphite powder, or a graphite powder and a lubricant. A copper powder is added where desired and a MnS powder may be added.

Explanation is hereinbelow provided as to the component requirements of the present invention.

Content of S in iron powder: about 0.03 to 0.30 wt % S is effective in increasing the amount of free graphite formed in a sintered material. Less than about 0.03 wt % S fails to supply the amount of free graphite desired to remain in the sintered material. Conversely, more than about 0.30 wt % S invites soot during sintering, thus rendering the resulting machine part susceptible to rusting. Hence, the content of S in the iron powder should be from about 0.03 to 0.3 wt %.

Desirably, according to the invention an atomized iron powder having an S content of about 0.03 to 0.3 wt %, Mn in a content of about 0.05 to 0.40 wt % and the balance Fe and incidental impurities is preferable.

Content of Mn in iron powder: about 0.05 to 0.40 wt % Mn is an element tending to reduce the amount of free graphite in a sintered material. When the content of Mn entering the iron powder through prealloying exceeds about 0.40 wt % in content, the amount of free graphite produced becomes insufficient in the sintered material, eventually rendering the sintered material less machinable and less slidable. Though the content of Mn is preferably as low as possible, the lower limit should be about 0.05 wt % to maintain a proper balance between the refining cost required for decreasing the content of Mn during preparation of components to be melted and the machinability of the sintered material. Desirably, the content of Mn in the iron powder is from about 0.07 to 0.15 wt %.

When it is found necessary, the atomized iron powder may be incorporated with one or both metals selected from Ni in a content of about 0.5 to 7.0 wt % and Mo in a content of about 0.05 to 6.0 wt % by means of prealloying.

Ni and Mo may be added by prealloying so as to enhance the strength of a sintered material. Less than about 0.5 wt % of Ni and less than about 0.05 wt % of Mo are ineffective to gain improved strength of the sintered material, whereas more than about 7.0 wt % of Ni and more than about 6.0 wt % of Mo cause a sharp decline in the machinability of the sintered material and also make it difficult to correct size of the latter material. Hence, in the case of prealloying addition, the content of Ni should be from about 0.5 to 7.0 wt % and the content of Mo from about 0.05 to 6.0 wt %.

The atomized iron powder can be produced by drying a raw powder derived by atomizing, with use of high-pressure water, molten steel formulated to have the above specified composition, followed by reduction heat treatment, pulverization and classification of the reduced powder. Here, the drying and reduction treatments may be conducted in known manner and without particular restriction placed thereon.

Where desired, one or more metals selected from Ni in a content of about 0.5 to 7.0 wt %, Cu in a content of about 0.5 to 7.0 wt % and Mo in a content of about 0.05 to 3.5 wt % may be added, by means of partial alloying, to an atomized iron powder comprised of S in a content of about 0.03 to 0.30 wt %, Mn in a content of about 0.05 to 0.40 wt % and the balance Fe and incidental impurities.

Also preferably, Ni, Cu and Mo may be partially alloyed by mixing powders of Ni, Cu and Mo or $MoO_3$ with the atomized powder and then by causing the partially alloyed powders to diffusively adhere to the powder. Ni, Cu and Mo are added to enhance the strength of the sintered material. In the case of partial alloying, one or more metals selected from Ni in a content of about 0.5 to 7.0 wt %, Cu in a content of about 0.5 to 7.0 wt % and Mo in a content of about 0.05 to 3.5 wt % are employed. Proportions below the lower limit of each such element produce no improvement in the strength of the sintered material. Above the upper limit of each such component leads to a marked decrease of machinability of the sintered material, requiring difficult or impossible sizing of the product.

On completion of bright hardening and carburization treatment, a portion of free graphite again dissolves in the iron powder to thereby give a highly strong structure with beinite and martensite predominantly contained.

Content of B-containing compound powder: about 0.001 to 0.3 wt % in terms of B

The content of a B-containing compound powder should be in the range of about 0.001 to 0.3 wt % expressed as B, based upon the total amounts of all of the iron powder, the B-containing compound powder, the graphite powder and, where used, the copper powder.

As the B-containing compound powder, oxides of B, nitrides of B, boric acid salts and the like are useful. Preferred among these are $B_2O_3$, $H_3BO_3$, ammonium borate and hexagonal BN. Desirably, they may be used as one or more combinations.

When one or more B-containing compound powders are added in an amount of about 0.001 wt % or above, expressed as B, the amount of free graphite remarkably increases in the sintered material, thus contributing greatly to further improvements of the machinability and sliding properties of the sintered material. Inversely, an amount above about 0.3 wt % expressed as B results in reduced compressibility of the sintered material. Hence, the amount of the B-containing compound powder or powders to be added should be in the range of about 0.001 to 0.3 wt % expressed as B.

Content of MnS powder: about 0.05 to 1.0 wt %

MnS powder is added preferably in an amount of about 0.05 to 1.0 wt % based upon the total of the amounts of all of iron powder, B-containing compound powder, MnS powder, graphite powder and, where used, copper powder. The MnS powder is used, where needed, in order to attain further improved machinability. Less than about 0.5 wt % of the MnS powder fails to effectively improve such property, whereas more than about 1.0 wt % produces no better results with only added cost burdens. Thus, the amount of MnS powder to be added should be in the range of about 0.05 to 1.0 wt %.

Content of graphite powder: about 0.5 to 3.0 wt %

A graphite powder is added preferably in an amount of about 0.5 to 3.0 wt % based upon all of the amounts of all of iron powder, one or more than one B-containing compound powder, graphite powder and, where used, copper powder.

The graphite powder is used as a source of graphite supply for influencing graphite to remain in the pores of the sintered material to attain improved sliding properties and machinability, or to dissolve in the resulting iron to gain enhanced strength. Less than about 0.5 wt % leads to diminished sliding properties and strength, whereas more than about 3.0 wt % results in an increased ratio of perlite, causing reduced machinability.

Content of copper powder: not more than about 4 wt %

Copper powder (Cu) is added preferably in an amount of about 4 wt % or below based upon the total of the amounts of all iron powder, one or more than one B-containing compound powder, graphite powder and copper powder.

The Cu powder is used, where desired, in order to improve strength without reducing machinability. Above about 4 wt % causes poor machinability.

Subsequently, a lubricant may preferably be added in an amount of about 2.0 parts by weight based on a total amount of 100 parts by weight of the iron powder, the B-containing compound powder, the graphite powder, the MnS powder where used and the copper powder where used. The resulting mixture may be mixed for a time in a conventional manner, as by a V-type blender.

Preferable lubricants include zinc stearate, oleic acid, mixtures of stearamide and N,N'-ethylenebis stearamide, lithium stearate and the like.

Batch mixing two or more times may also be acceptable. In this instance, the iron powder and B-containing compound powder are mixed, as by a V-type blender, followed by mixing the resulting powder mixture with the graphite powder, lubricant, MnS powder where desired and copper powder, where desired, as by a V-type blender.

Additionally, after segregation-free treatment is accomplished, the B-containing compound powder may be mixed to adhere to the iron powder on its surface. Such mixing method can be carried out as described below.

Mixing is effected in which the iron powder is mixed with a liquid fatty acid at room temperature, and mixing is then effected in which the B-containing compound powder, graphite powder, MnS powder where desired and copper powder where desired are added and mixed. A eutectic mixture of a fatty acid and a metallic soap is formed with a rise in temperature during and after mixing. Thereafter, mixing is effected in which the eutectic mixture is solidified with cooling so that at least the B-containing compound powder is caused to adhere to the surface of the iron powder through the bonding the eutectic mixture, and mixing is effected in which a metallic soap or a wax is added and mixed during cooling. This segregation-free treatment leads to an iron powder having the B-containing compound powder adherent to its surface. Thus, the amount of free graphite formed in the sintered material is larger than that in the case of simple mixing by a V-type blender.

The mixing steps thus defined may be modified in many ways. For example, the B-containing compound powder and metallic soap may be mixed at first and the graphite powder, copper powder, where desired, and metallic soap or wax may be added during subsequent mixing.

Alternatively, mixing may be effected in which the iron powder is mixed with the B-containing compound powder and the graphite powder, and with MnS powder where desired and/or copper powder where desired, and two or more waxes having different melting points may be mixed. A partial melt of the waxes is formed with a rise in temperature during or after the mixing. Further mixing is then effected in which the partial melt is solidified with cooling with the result that at least the B-containing compound powder is caused to adhere to the surface of the iron powder through the bonding the partial melt, and still further mixing is effected in which a metallic soap and/or a wax is added and mixed during cooling. The mixing steps stated above may also be further modified in part, with the B-containing compound powder and the two or more waxes of different melting points are added during one mixing at first, and the graphite powder, copper powder where desired and metallic soap or wax are added during another mixing.

Subsequently to completion of the mixing, press molding may desirably be conducted to obtain a green compact of a predetermined density which is then sintered to produce a sintered material.

The drawings illustrate various methods for performing the procedure described in detail in the Examples that follow.

FIG. 1A of the drawings is a schematic view showing relationships in a powder mixture obtained in accordance with this invention. The number 1 designates an iron powder particle, 2 represents a boron-containing compound particle, 3 designates a particle of graphite, and 4 designates a particle of lubricant. This drawing is shown schematically but indicates how the particles 2, 3 and 4 are bound to the particle 1 of iron.

Figure 1B:
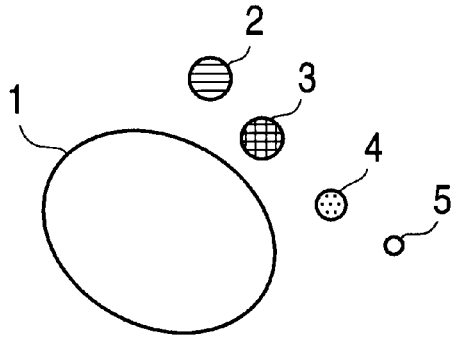
FIG. 1B is a schematic view similar to FIG. 1A, but shows a powder mixture comprising added MnS powder.

FIG. 1B is similar to FIG. 1, but also shows a particle 5, in accordance with this invention, which is a manganese sulfide (MnS) powder.

Figure 2:
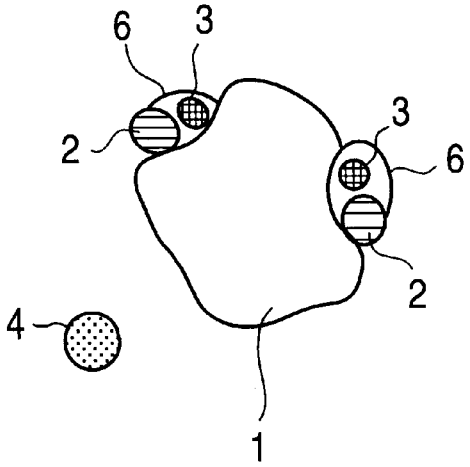
FIG. 2 is a schematic view showing a powder mixture according to the invention by the mixing method 2A.

FIG. 2 shows an alternative form of the invention wherein a eutectic mixture 6 is shown having entrapped particles 2, 3 at various places on the surface of the particle 1, causing them to adhere together.

Figure 3:
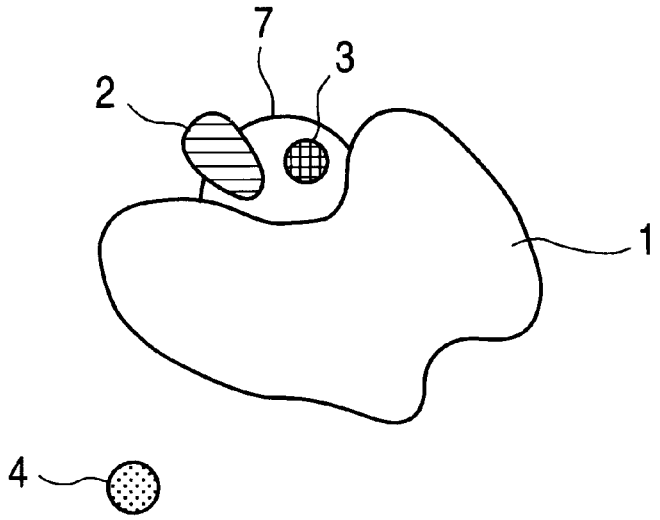
FIG. 3 is a schematic view showing a further powder mixture of the invention by the mixing method 3A.

FIG. 3 is a view similar to FIG. 2, but shows the material 7, partially melt particle as having entrapped particles 2 and 3 and adhering them to the iron powder 1. FIG. 3 does not show any manganese sulfide, where mixed if desired, MnS is adhered to iron powder through partially meet particle 7 as B containing compound powder 2 does shown in FIG. 3.

Figure 4:
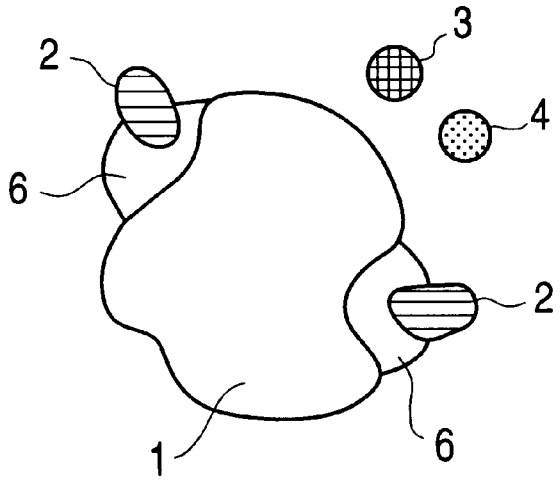
FIG. 4 is a schematic view showing a still further powder mixture of the invention by the mixing method 4A.

FIG. 4 shows a schematic view of powder structure obtained by mixing process 3A. B containing compounds particle 2 is adhered to the surface of iron powder through partially melt particle 7. Graphite particle 3 or MnS particle if added, and lubricant 4 are not adhered to the iron powder.

Figure 5:
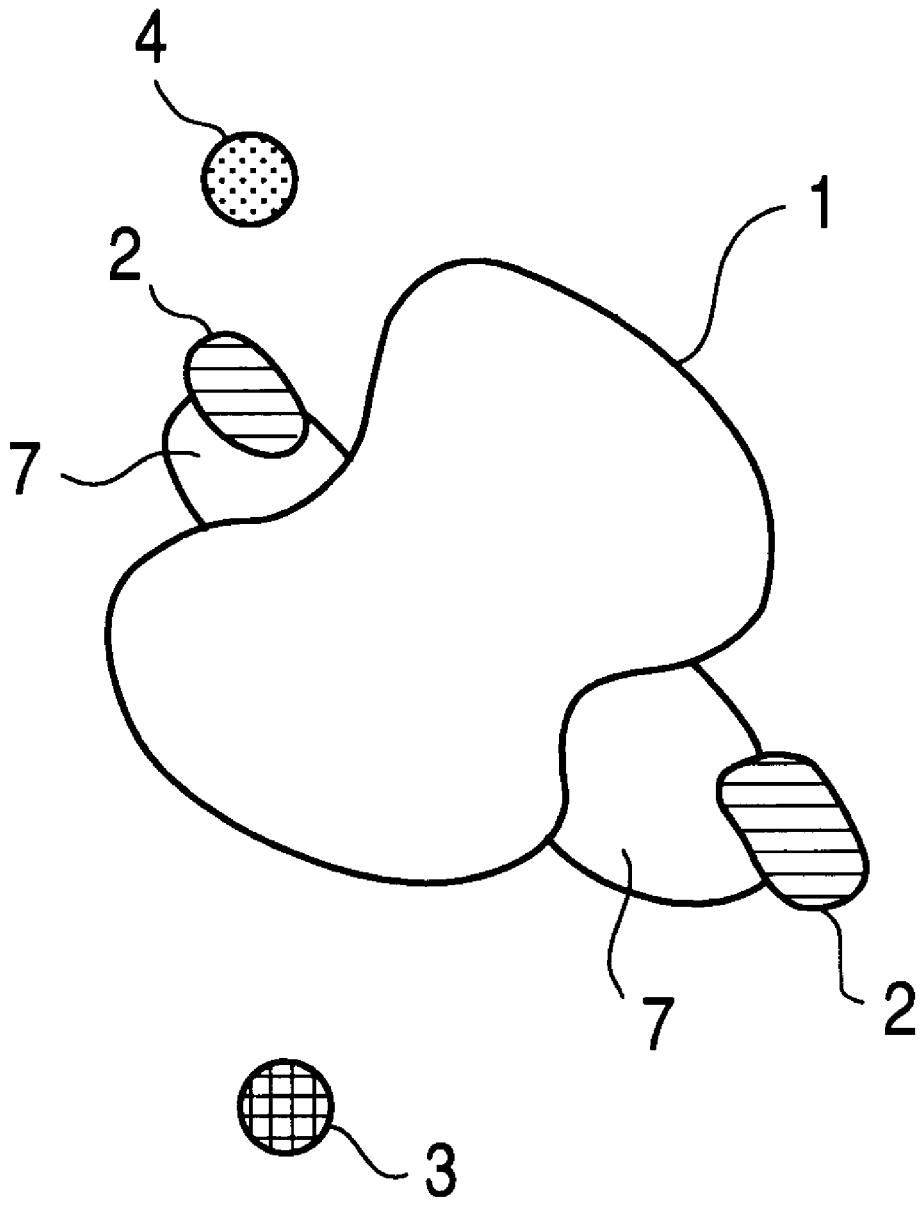
FIG. 5 is a schematic view showing yet another powder mixture obtained by another form of the invention, which is the mixing method 5A.

FIG. 5 shows a somewhat similar arrangement, but utilizing the material 7, to be described in further detail hereinafter, entrapping the B containing compound 2 and itself attaching to the iron powder 1. In FIG. 5 the material 3, which is the graphite powder, is shown as being unattached to the iron powder at the particular time involved, as well as MnS powder if added.

EXAMPLES

Example 1

An atomized iron powder was prepared which was formulated to contain S and Mn as shown in Table 1 and Fe and incidental impurities as the balance.

Firstly, a molten steel (1,630° C.) adjusted to have a predetermined composition was atomized with water into powdered form. After being dried in a nitrogen atmosphere at 140° C. for 60 minutes, the resulting powder was subjected to reduction treatment in an all-hydrogen atmosphere at 930° C. for 20 minutes. On cooling, the powder thus treated was taken out of the reducing oven, pulverized and classified to provide an atomized iron powder.

The atomized iron powder obtained above was mixed with a B-containing compound powder, an MnS powder, a graphite powder, a Cu powder and a lubricant. Mixing was performed with use of mixing methods 1 to 5 further described hereinafter. The amount of each of the B-containing compound powder, graphite powder, MnS powder and Cu powder to be added is stated as weight percentage based on the total amount of the iron powder, B-containing compound powder, graphite powder and Cu powder. In Table 1, the amount of one or more B containing compound powders are shown as B content in B containing compounds powder.

Mixing Method 1

(1) The atomized iron powder was incorporated with one or more of boric acid ($H_3BO_3$), boron oxide ($B_2O_3$), ammonium borate powder and hexagonal boron nitride, the amounts of which are stated in Table 1, along with 1.5 wt % of a graphite powder and 2.0 wt % of a Cu powder. Some of the atomized iron powder samples were further incorporated with an MnS powder in those amounts tabulated in Table 1 and zinc stearate in an amount of 1 part by weight based on a total amount of 100 parts by weight of the components used. Mixing was conducted with a V-type blender for 15 minutes, whereby powder mixtures were prepared.

Mixing Method 2

(1) To the atomized iron powder was sprayed 0.3 wt % of oleic acid, and the resulting iron powder was uniformly mixed for 3 minutes.

(2) Subsequently, one or more B-containing compound powders in those amounts tabulated in Table 1, and, where used as stated in Table 1, 1.5 wt % of a graphite powder, 2.0 wt % of a Cu powder and zinc stearate in an amount of 0.4 part by weight based on a total amount of 100 parts by weight of the components used were added and mixed fully. Mixing was then performed with heating at 110° C.

(3) Cooling was effected with continued mixing at 85° C. or below so that the graphite powder and B-containing compound powders were caused to adhere to iron powder particles through a eutectic mixture of oleic acid and zinc stearate as a binding agent, whereby powder mixtures were prepared.

(4) To the resulting powder mixture was added zinc stearate in an amount of 0.3 part by weight based on a total amount of 100 parts by weight of the iron powder, oleic acid, one or more B-containing compound powders, graphite powder and Cu powder. Then, the whole mixture was uniformly mixed.

Mixing Method 3

(1) To the atomized iron powder were added one or more B-containing compound powders in those amounts as stated in Table 1, 1.5 wt % of a graphite powder, 2.0 wt % of a Cu powder and 0.4 wt % of a mixture of stearamide and N,N'-ethylenebis stearamide, and the resulting mixture was fully mixed. Further mixing was done with heating at 110° C.

(2) Cooling was performed with continued mixing at 85° C. or below so that the graphite powder and B-containing compound powder were caused to adhere to iron powder particles through a partially melt mixture of stearamide and N,N'-ethylenebis stearamide as a binding agent, whereby powder mixtures were prepared.

(3) To the resulting powder mixture was added zinc stearate in an amount of 0.30 part by weight based on a total amount of 100 parts by weight of the iron powder, B-containing compound powder, graphite powder, Cu powder and mixture of stearamide and N,N'-ethylenebis stearamide. The whole mixture was uniformly mixed.

Mixing Method 4

(1) To the atomized iron powder was sprayed 0.3 wt % of oleic acid, and the resulting iron powder was uniformly mixed for 3 minutes.

(2) Subsequently, one or more B-containing compound powders in those amounts tabulated in Table 1 and zinc stearate in an amount of 0.4 part by weight based on a total amount of 100 parts by weight of the iron powder, oleic acid, graphite powder and Cu powder were added and mixed fully. Mixing was then done with heating at 110° C.

(3) Cooling was effected with continued mixing at 85° C. or below so that the B-containing compound powders were caused to adhere to iron powder particles through an eutectic mixture of oleic acid and zinc stearate as a binding agent, whereby powder mixtures were prepared.

(4) To the resulting powder mixture were 1.5 wt % of a graphite powder, 2.0 wt % of a Cu powder and zinc stearate in an amount of 0.3 part by weight based on a total amount of 100 parts by weight of the iron powder, B-containing compound powders, graphite powder, Cu powder and oleic acid. The whole mixture was uniformly mixed.

Mixing Method 5

(1) To the atomized iron powder were added one or more B-containing compound powders in those amounts tabulated in Table 1 and 0.4 wt % of a mixture of stearamide and N,N'-ethylenebis stearamide, and the resulting mixture was fully mixed. Further mixing was performed with heating at 110° C.

(2) Cooling was performed with continued mixing at 85° C. or below so that one or more B-containing compound powder was caused to adhere to iron powder particles through a partially melting mixture of stearamide and N,N'-ethylenebis stearamide as a binding agent, whereby powder mixtures were prepared.

(3) To the resulting powder mixture were added 1.5 wt % of a graphite powder, 2.0 wt % of a Cu powder and zinc stearate in an amount of 0.3 part by weight based on a total amount of 100 parts by weight of the iron powder, mixture of stearamide and N,N'-ethylenebis stearamide, graphite powder and Cu powder. The whole mixture was uniformly mixed.

The powder mixtures provided above were pressed to produce green compacts.

Compressibility was adjudged by determining the density of a green compact produced from the above powder mixture into a cylindrical shape of 10 ϕ×10 mm under 6 tons/cm$^2$. The higher the density, the better the compressibility.

Both the amount of free graphite and machinability were evaluated by use of a sintered material that had been obtained by pressing the powder mixture into a cylindrical shape of 6.85 g/cm$^3$ in density and then by sintering the resulting green compact in an atmosphere containing 10 vol% of hydrogen and 90 vol % of nitrogen at 1,130° C. for 20 minutes.

The amount of free graphite in the sintered material was determined by infrared absorption of a filtrate resulting from dissolution of a portion (test specimen) of the sintered material in nitric acid and from subsequent removal of the resulting residue by filtration. Moreover, machinability was evaluated by counting the average number of drilled holes (average numerical value by use of 3 drills) required for a high-speed steel drill of 2 mm ϕ in diameter to become inoperatively drilled when made to rotate under conditions of 10,000 rpm and 0.012 mm/rev. In this case, use was made of a sintered material of a cylindrical shape of 60 mm ϕ in outer diameter and 10 mm in height. The larger the numerical value, the better the machinability.

The results obtained are shown in Table 1.

TABLE 1

| Sintered material | Composition of iron powder (wt %) | | Composition of powder (wt %) | | | | | | Sintered material | | | |
|---|---|---|---|---|---|---|---|---|---|---|---|---|
| | | | B compound powder (expressed as B) | | | | | | Green compact | Amount of | Machinability/ tool life | |
| | | | | | Ammonium | | MnS | Mixing | Compressibility | free graphite | of machine | |
| No. | S | Mn | $H_3BO_3$ | $B_2O_3$ | borate | BN | powder | method | Mb/m$^3$ | wt % | tool piece | Remarks |
| 1 | 0.04 | 0.15 | — | 0.01 | — | 0.01 | — | 1 | 6.85 | 0.60 | 330 | Inventive ex. |
| 2 | 0.08 | 0.06 | — | — | — | 0.07 | — | 1 | 6.84 | 0.80 | 450 | Inventive ex. |
| 3 | 0.27 | 0.25 | 0.15 | — | — | — | — | 1 | 6.84 | 1.20 | 500 | Inventive ex. |
| 4 | 0.10 | 0.09 | — | — | 0.20 | — | — | 1 | 6.82 | 0.25 | 520 | Inventive ex. |
| 5 | 0.06 | 0.10 | — | — | — | — | — | 1 | 6.95 | 0.02 | 10 | Inventive ex. |

TABLE 1-continued

| Sintered material No. | Composition of iron powder (wt %) S | Mn | Composition of powder (wt %) B compound powder (expressed as B) $H_3BO_3$ | $B_2O_3$ | Ammonium borate | BN | MnS powder | Mixing method | Green compact Compressibility $Mb/m^3$ | Sintered material Amount of free graphite wt % | Machinability/ tool life of machine tool piece | Remarks |
|---|---|---|---|---|---|---|---|---|---|---|---|---|
| 6 | 0.15 | 0.12 | 0.40 | — | — | — | — | 1 | 6.68 | 1.05 | 530 | Comparative ex. |
| 7 | 0.02 | 0.10 | 0 08 | — | — | — | — | 1 | 6.84 | 0.08 | 80 | Comparative ex. |
| 8 | 0 06 | 0.43 | 0 08 | — | — | — | — | 1 | 6.84 | 0.30 | 90 | Comparative ex. |
| 9 | 0.27 | 0.25 | — | — | — | 0.05 | — | 1 | 6.85 | 0.60 | 320 | Comparative ex. |
| 10 | 0.27 | 0.25 | 0.15 | — | — | — | — | 2 | 6.85 | 1.30 | 530 | Inventive ex. |
| 11 | 0.27 | 0.25 | 0.15 | — | — | — | — | 3 | 6.85 | 1.33 | 525 | Inventive ex. |
| 12 | 0.27 | 0.25 | 0.15 | — | — | — | — | 4 | 6.85 | 1.32 | 520 | Inventive ex. |
| 13 | 0.27 | 0.25 | 0.15 | — | — | — | — | 5 | 6.85 | 1.31 | 515 | Inventive ex. |
| 14 | 0.04 | 0.15 | — | 0.01 | — | 0.01 | 0.25 | 1 | 6.83 | 0.53 | 510 | Inventive ex. |
| 15 | 0.04 | 0.15 | — | 0.01 | — | 0.01 | 0.50 | 1 | 6.82 | 0.50 | 500 | Inventive ex. |

As evidenced by Table 1, a conspicuous rise of machinability was achieved in the sintered materials (No. 1 to No. 4 and No. 9 to No. 13) produced from the iron based powder mixtures for powder metallurgy according to the present invention. In sintered material No. 6 wherein the amounts of B-containing compound powders fell outside the scope of the invention, compressibility decreased though machinability did not appreciably deteriorate. Sintered material No. 5 wherein boric acid ($H_3BO_3$) was not present, sintered material No. 7 wherein the content of S was too small, and sintered material No. 8 wherein the content of Mn was too large, were all deficient in the amount of free graphite present and were accordingly poor in relation to machinability. When comparison was made between sintered materials No. 3, No. 10 and No. 11 to No. 13 in which boric acid was added in one and the same amount, but different mixing methods were employed, sintered materials No. 10 and No. 11 to No. 13 having undergone segregation-free treatment revealed larger amounts of free graphite and hence higher machinability than sintered material No. 3. Sintered materials having a MnS powder contained therein (No. 14 and No. 15) show prolonged tool life of a machine tool in contrast to sintered material No. 1, and this means that addition of the MnS powder leads to further improvement in machinability.

Example 2

An atomized iron powder was prepared which was formulated to contain S and Mn as shown in Table 2 and used as a starting powder.

Firstly, a molten steel (1,630° C.), adjusted to a predetermined composition, was atomized with water into powdered form. After being dried in a nitrogen atmosphere at 140° C. for 60 minutes, the resulting powder was subjected to reduction treatment in an all-hydrogen atmosphere at 930° C. for 20 minutes. On cooling, the powder thus treated was taken out of the reducing oven, pulverized and classified to provide an atomized iron powder as the starting powder.

The starting powder obtained above was mixed with a carbonyl Ni powder, a Mo trioxide powder and a Cu powder to have a composition stated in Table 2. The resulting mixture was annealed in a hydrogen gas at 875° C. for 60 minutes with the result that those component powders were caused to diffusively attach to the starting powder on its surface, whereby alloy steel powders were partially alloyed. Here, the contents of any Ni, Mo and Cu as shown in Table 2 are shown, expressed by weight percentage in the iron powder.

The alloy steel powder was mixed with one or more B-containing compound powders in the amounts stated in Table 2, an MnS powder, a graphite powder, a Cu powder and a lubricant as stated. Mixing was performed with use of mixing methods 1A to 5A to be described hereinafter. Here, the amount of each B-containing compound powder, MnS powder and graphite powder to be added is expressed in the Table by weight percentage based on the total amount of the alloy steel powder, B-containing compound powder, MnS powder and graphite powder. In Table 2, the amounts of one or more B containing compounds powder added are shown as B content in B containing compounds powder.

Mixing Method 1A (1) The alloy steel powder was incorporated with the stated amounts of boric acid ($H_3BO_3$), boron oxide ($B_2O_3$), ammonium borate powder and hexagonal boron nitride, the amounts of which are tabulated in Table 2, along with 1.5 wt % of a graphite powder. Some of the atomized iron powder were further incorporated with an MnS powder in the amounts tabulated in Table 2, and zinc stearate in an amount of 1 part by weight based on a total amount of 100 parts by weight of the components used. Mixing was conducted with a V-type blender for 15 minutes, whereby powder mixtures were prepared.

FIG. 1A of the drawings is a schematic view showing relationships in a powder mixture obtained by the mixing method 1A according to the present invention. FIG. 1B is similar to FIG. 1A, but shows a powder mixture having an MnS powder further added thereto.

The number 1 designates an iron powder, 2 is a B-containing compound powder, 3 a graphite powder, 4 a lubricant and at 5 (FIG. 1B) an MnS powder.

Mixing Method 2A (1) To the alloy steel powder was sprayed 0.3 wt % of oleic acid, and the resulting iron powder was uniformly mixed for 3 minutes.

(2) Subsequently, B-containing compound powder in those amounts tabulated in Table 2, 1.5 wt % of graphite powder and zinc stearate in an amount of 0.4 part by weight based on a total amount of 100 parts by weight of all of iron powder, B containing compounds powder and graphite powder were added and mixed fully. Mixing was then done with heating at 110° C.

(3) Cooling was effected with continued mixing at 85° C. or below and the graphite powder and B containing compound powder were caused to adhere to iron powder particles through a eutectic mixture of oleic acid and zinc stearate as a binding agent, whereby powder mixtures were prepared.

(4) To the resulting powder mixture was added zinc stearate in an amount of 0.3 part by weight based on a total amount of 100 parts by weight of the iron powder, oleic acid, B-containing compound powder and graphite powder. Then the whole mixture was uniformly mixed.

FIG. 2 of the drawings is a schematic view showing a powder mixture obtained by the mixing method 2A of this invention. A portion showing is designated as a eutectic mixture.

Mixing Method 3A (1) To the alloy steel powder were added one or more B-containing compound powders in those amounts tabulated in Table 2, 1.5 wt % of a graphite powder and 0.4 wt % of a mixture of stearamide and N,N'-ethylenebis stearamide, and the resultant mixture was fully mixed. Further mixing was performed with heating at 110° C.

(2) Cooling was performed with continued mixing at 85° C. or below, and the graphite powder and B containing compound powder were caused to adhere to iron powder particles through a partially melting mixture of stearamide and N,N'-ethylenebis stearamide as a binding agent, whereby powder mixtures were prepared.

(3) To the resulting powder mixture was added zinc stearate and N,N'-ethylenebis stearamide in an amount of 0.3 part by weight based on a total amount of 100 parts by weight of the iron powder, wherein both lubricants were added by 0.15 parts each, one or more B-containing compound powders, graphite powder and ing melt mixture of stearamide and N,N'-ethylenebis stearamide. The whole mixture was uniformly mixed.

FIG. 3 is a schematic view showing a powder mixture obtained by the mixing method 3A of the drawings.

Mixing Method 4A (1) To the alloy steel powder was sprayed 0.3 wt % of oleic acid, and the resulting steel powder was uniformly mixed for 3 minutes.

(2) Subsequently, B-containing compound powders in the amounts stated in Table 2 and zinc stearate in an amount of 0.4 part by weight based on a total amount of 100 parts by weight of the iron powder, oleic acid and graphite powder were added and mixed fully. Mixing was then done with heating at 110° C.

(3) Cooling was effected with continued mixing at 85° C. or below so that the graphite powder and B containing compound powder were caused to adhere to iron powder particles through a eutectic mixture of stearamide and N,N'-ethylenebis stearamide as a binding agent, whereby powder mixtures were prepared.

(4) To the resulting powder mixture were 1.5 wt % of a graphite powder and zinc stearate in an amount of 0.3 part by weight based on a total amount of 100 parts by weight of the iron powder, one or more B-containing compound powders, graphite powder and oleic acid. The whole mixture was uniformly mixed.

FIG. 4 is a schematic view showing a powder mixture obtained by the mixing method 4A of this invention.

Mixing Method 5A (1) To the alloy steel powder were added one or more B-containing compound powders in the amounts stated in Table 2 and 0.4 wt % of a mixture of stearamide and N,N'-ethylenebis stearamide, and the resulting mixture was fully mixed. Further mixing was performed with heating at 110° C.

(2) Cooling was performed with continued mixing at 85° C. or below so that the one or more B-containing compound powders were caused to adhere to iron powder particles through a ing melt mixture of stearamide and N,N'-ethylenebis stearamide as a binding agent, whereby powder mixtures were prepared.

(3) To the resulting powder mixture were 1.5 wt % of a graphite powder and zinc stearate and N,N'-ethylenebis stearamide in an amount of 0.3 part by weight based on a total amount of 100 parts by weight of the iron powder, mixture of stearamide and N,N'-ethylenebis stearamide, graphite powder and B-containing compound powders. The whole mixture was uniformly mixed.

FIG. 5 is a schematic view showing a typical powder mixture obtained by the mixing method 5A of this invention.

The powder mixtures based upon the mixing methods 1A to 5A were pressed to thereby form green compacts.

Both the amount of free graphite and machinability were evaluated, as in Example 1, by use of a sintered material that had been obtained by press molding the powder mixture into a cylindrical shape of 7.0 g/cm$^3$ in density and then by sintering the resultant green compact in an atmosphere containing 10 vol % of hydrogen and 90 vol % of Nitrogen at 1,250° C. for 60 minutes.

Compressibility was adjudged in the same manner as in Example 1.

Examination was further made of the possibility of sizing after sintering in each case. In addition, tensile strength after bright temperating was measured by heating sintered material in an atmosphere of 0.8% in carbon potential at 850° C. for 30 minutes and then by hardening the treated sintered material in an oil of 160° C.

The results obtained are stated in Table 2.

TABLE 2

| Sintered Material | Composition of iron powder (wt %) | | | | | Composition of mixed powder (% wt) B Compound powder (in terms of B) | | | | MnS powder | Mixing method | Green compact Compressibility | Sintered material Amount of free graphite | Machinability/tool life of machine | Possibility of correction | Tensile strength of heat treated material | Remark |
|---|---|---|---|---|---|---|---|---|---|---|---|---|---|---|---|---|---|
| No. | S | Mn | Ni | Cu | Mo | $H_3BO_3$ | $B_2O_3$ | Ammonium borate | BN | | | Mg/m$^3$ | wt % | tool piece | | MPa | |
| 2-1 | 0.15 | 0.10 | 4.00 | 0.50 | 1.50 | 0.03 | — | — | — | — | 1A | 6.90 | 0.90 | 200 | Yes | 900 | *ex. |
| 2-2 | 0.08 | 0.08 | 2.00 | 1.00 | 1.50 | 0.16 | — | — | — | — | 1A | 6.91 | 1.20 | 290 | Yes | 850 | *ex. |
| 2-3 | 0.12 | 0.12 | 6.00 | 2.00 | 0.50 | — | — | — | 0.10 | — | 1A | 6.90 | 1.20 | 250 | Yes | 951 | *ex. |
| 2-4 | 0.06 | 0.06 | 2.00 | — | 1.00 | — | — | 0.12 | — | — | 1A | 6.88 | 1.15 | 220 | Yes | 900 | *ex. |
| 2-5 | 0.25 | 0.15 | 2.00 | — | 2.00 | — | 0.20 | — | — | — | 1A | 6.90 | 1.20 | 200 | Yes | 800 | *ex. |

TABLE 2-continued

| Sintered Material No. | Composition of iron powder (wt %) S | Mn | Ni | Cu | Mo | Composition of mixed powder (% wt) B Compound powder (in terms of B) $H_3BO_3$ | $B_2O_3$ | Ammonium borate | BN | MnS powder | Mixing method | Green compact Compressibility Mg/m$^3$ | Sintered material Amount of free graphite wt % | Machinability/tool life of machine tool piece | Possibility of correction | Tensile strength of heat treated material MPa | Remark |
|---|---|---|---|---|---|---|---|---|---|---|---|---|---|---|---|---|---|
| 2-6 | 0.08 | 0.08 | — | 3.00 | — | — | — | — | 0.02 | — | 1A | 6.91 | 0.60 | 190 | Yes | 700 | *ex. |
| 2-7 | 0.22 | 0.10 | — | — | 2.00 | 0.07 | — | — | — | — | 1A | 6.91 | 1.20 | 240 | Yes | 850 | *ex. |
| 2-8 | 0.12 | 0.08 | 4.00 | 0.50 | 1.50 | — | — | — | — | — | 1A | 6.90 | 0.02 | 1 | No | 780 | **ex. |
| 2-9 | 0.15 | 0.10 | 4.00 | 0.50 | 1.50 | 0.35 | — | — | — | — | 1A | 6.70 | 0.92 | 240 | Yes | 720 | **ex. |
| 2-10 | 0.01 | 0.08 | 4.00 | 0.50 | 1.50 | 0.06 | — | — | — | — | 1A | 6.90 | 0.05 | 3 | No | 1000 | **ex. |
| 2-11 | 0.10 | 0.43 | 4.00 | 0.50 | 1.50 | 0.08 | — | — | — | — | 1A | 6.90 | 0.30 | 10 | No | 850 | **ex. |
| 2-12 | 0.08 | 0.08 | 8.00 | 0.50 | 1.50 | 0.10 | — | — | — | — | 1A | 6.85 | 0.70 | 30 | No | 1100 | **ex. |
| 2-13 | 0.10 | 0.10 | — | 8.00 | — | 0.08 | — | — | — | — | 1A | 6.85 | 0.65 | 32 | No | 800 | **ex. |
| 2-14 | 0.12 | 0.06 | 2.00 | — | 5.00 | 0.15 | — | — | — | — | 1A | 6.87 | 0.66 | 25 | No | 1000 | **ex. |
| 2-15 | 0.10 | 0.10 | 4.00 | 0.50 | 1.00 | — | — | — | 0.10 | — | 1A | 6.90 | 1.20 | 260 | Yes | 900 | *ex. |
| 2-16 | 0.08 | 0.08 | 2.00 | 1.00 | 1.50 | — | — | — | 0.16 | — | 2A | 6.91 | 1.30 | 300 | Yes | 960 | *ex. |
| 2-17 | 0.08 | 0.08 | 2.00 | 1.50 | 1.50 | 0.16 | — | — | — | — | 3A | 6.92 | 1.32 | 310 | Yes | 960 | *ex. |
| 2-18 | 0.12 | 0.07 | 4.00 | 1.50 | 1.50 | — | — | — | 0.15 | — | 4A | 6.90 | 1.32 | 300 | Yes | 900 | *ex. |
| 2-19 | 0.12 | 0.07 | 4.00 | 1.50 | 1.50 | 0.10 | — | — | — | — | 5A | 6.90 | 1.30 | 310 | Yes | 920 | *ex. |
| 2-20 | 0.15 | 0.10 | 4.00 | 0.50 | 1.50 | 0.03 | — | — | — | 0.25 | 1A | 6.87 | 0.95 | 310 | Yes | 860 | *ex. |
| 2-21 | 0.15 | 0.10 | 4.00 | 0.50 | 1.50 | 0.03 | — | — | — | 0.50 | 1A | 6.87 | 0.90 | 310 | Yes | 860 | *ex. |

*ex.: Invention example
**ex.: Comparative example

As is clear from Table 2, sintered materials (No. 2-1 to 2-7 and No. 2-15 to No. 2-19) resulting from use of the iron based powder mixtures for powder metallurgy according to the present invention contain free graphite in amounts of not less than 0.60 wt % and had a tool life of a machine tool exceeding 190 pieces or more as an index of machinability, thus exhibiting remarkable improvement in machinability. Because of addition of Ni, Cu and Mo, each of these sintered materials also have a tensile strength after bright hardening as high as 700 to 960 MPa, and hence very high strength. Besides and noticeably, sizing is possible as sintered.

In contrast, in sintered materials Nos. 2–9 wherein the amounts of B-containing compound powder departed from the scope of the invention, compressibility reduced, though machinability was not so much lowered. Sintered material No. 2-8 wherein B-containing compound powder was absent, sintered material No. 2-10 wherein the content of S was too small and sintered material No. 2-11 wherein the content of Mn was too large, were low in respect of machinability and unadaptable to sizing. Sintered materials No. 2-12, No. 2-13 and No. 2-14, in which the amounts of alloys were too large, were conducive to decreased machinability and impossibility of sizing.

When comparison was made between sintered materials No. 2-2, No. 2-16 and No. 2-17 in which B content was added in the same amount, but in which different mixing methods were employed, sintered materials Nos. 2-16 and No. 2-17 treated to be free of segregation revealed large amounts of free graphite and hence high machinability as compared to sintered material No. 2-2. Sintered materials having MnS powder contained therein (No. 2-20 and No. 2-21) show prolonged tool life of machine tool, in contrast to sintered material No. 2-1, this meaning that addition of the MnS powder brings about further improved machinability.

Example 3

An atomized iron powder was prepared which was formulated to contain S, Mn, Ni and Mo as shown in Table 3 and Fe and incidental impurities as the balance.

Firstly, a molten steel adjusted to a given composition was atomized with water into powdered form. After being dried in a nitrogen atmosphere at 140° C. for 60 minutes, the resulting powder was subjected to reduction treatment in an all-hydrogen atmosphere at 930° C. for 20 minutes. On cooling, the powder thus treated was taken out of the reducing oven, pulverized and classified to provide an atomized iron powder (alloy steel powder).

The alloy steel powder was mixed with one or more B-containing compound powders in those amounts tabulated in Table 3, MnS powder, graphite powder and a lubricant. Mixing was performed with use of the mixing methods 1A to 5A shown in Example 2, whereby powder mixtures were provided. These powder mixtures were pressed to form green compacts. Here, the amount of each of the B-containing compound powders, MnS powder and graphite powder to be added is expressed as weight percentage based on the total amount of the iron powder, B-containing compound powder, MnS powder and graphite powder. In Table 3, the amount of one or more B containing compounds powder added are shown as B content in B containing compounds powder.

Both the amount of free graphite and machinability were evaluated, as in Example 1, by use of a sintered material that had been obtained by pressing the powder mixture into a cylindrical shape of 7.0 g/cm$^3$ in density and then by sintering the resulting green compact in an atmosphere containing 10 vol % of hydrogen and 90 vol % of nitrogen at 1,250° C. for 60 minutes.

Compressibility was adjudged in the same manner as in Example 1.

Sizing possibility after sintering and tensile strength after bright hardening were examined in the same manner as in Example 2.

The results obtained are stated in Table 3.

TABLE 3

| Sintered Material | Composition of iron powder (wt %) | | | | Composition of powder (% wt) B Compound powder (in terms of B) | | | | | Mixing | Green compact density | Sintered material Amount of free graphite | Machinability/tool life of machine | Possibility of correction | Tensile strength of heat treated material | Re- |
|---|---|---|---|---|---|---|---|---|---|---|---|---|---|---|---|---|
| No. | S | Mn | Ni | Mo | $H_3BO_3$ | $B_2O_3$ | Ammonium borate | BN | MnS powder | method | $Mg/m^3$ | wt % | tool piece | tion | MPa | mark |
| 3-1 | 0.10 | 0.25 | 2.00 | 0.50 | 0.05 | — | — | 0.02 | — | 1A | 6.70 | 0.80 | 180 | Yes | 1050 | *ex. |
| 3-2 | 0.05 | 0.10 | 2.00 | 1.00 | — | 0.12 | — | — | — | 1A | 6.80 | 1.10 | 185 | Yes | 1000 | *ex. |
| 3-3 | 0.06 | 0.08 | — | 0.50 | — | — | 0.25 | — | — | 1A | 6.82 | 1.10 | 190 | Yes | 730 | *ex. |
| 3-4 | 0.08 | 0.12 | — | 2.00 | 0.01 | — | — | — | — | 1A | 6.85 | 0.80 | 180 | Yes | 800 | *ex. |
| 3-5 | 0.12 | 0.10 | — | 5.00 | — | — | — | 0.10 | — | 1A | 6.80 | 1.20 | 190 | Yes | 880 | *ex. |
| 3-6 | 0.11 | 0.09 | 2.00 | 2.00 | — | — | — | — | — | 1A | 6.80 | 0.01 | 1 | No | 990 | **ex. |
| 3-7 | 0.08 | 0.10 | 2.00 | 1.00 | 0.35 | — | — | — | — | 1A | 6.55 | 0.90 | 195 | Yes | 980 | **ex. |
| 3-8 | 0.01 | 0.10 | 2.00 | 1.00 | 0.25 | — | — | — | — | 1A | 6.70 | 0.02 | 3 | No | 1100 | **ex. |
| 3-9 | 0.06 | 0.43 | 2.00 | 0.50 | 0.10 | — | — | — | — | 1A | 6.75 | 0.30 | 15 | No | 1050 | **ex. |
| 3-10 | 0.10 | 0.08 | 8.00 | — | 0.18 | — | — | — | — | 1A | 6.70 | 0.80 | 30 | No | 1100 | **ex. |
| 3-11 | 0.07 | 0.12 | — | 7.00 | 0.06 | — | — | — | — | 1A | 6.75 | 0.85 | 25 | No | 900 | **ex. |
| 3-12 | 0.06 | 0.08 | — | 0.50 | — | — | 0.25 | — | — | 2A | 6.85 | 1.27 | 200 | Yes | 740 | *ex. |
| 3-13 | 0.06 | 0.08 | — | 0.50 | — | — | 0.25 | — | — | 3A | 6.85 | 1.26 | 210 | Yes | 740 | *ex. |
| 3-14 | 0.09 | 0.15 | 2.00 | 1.00 | — | — | — | 0.10 | — | 4A | 6.85 | 1.30 | 200 | Yes | 720 | *ex. |
| 3-15 | 0.10 | 0.15 | 1.50 | 2.00 | 0.10 | — | — | — | — | 5A | 6.85 | 1.30 | 220 | Yes | 730 | *ex. |
| 3-16 | 0.10 | 0.25 | 2.00 | 0.50 | 0.05 | — | — | 0.02 | 0.25 | 1A | 6.70 | 0.85 | 240 | Yes | 980 | *ex. |
| 3-17 | 0.10 | 0.25 | 2.00 | 0.50 | 0.05 | — | — | 0.02 | 0.25 | 1A | 6.70 | 0.85 | 250 | Yes | 980 | *ex. |

*ex.: Invention example
**ex.: Comparative example

As is apparent from Table 3, sintered materials (No. 3-1 to No. 3-5 and No. 3-12 to No. 3-15) according to the present invention possess free graphite in amounts of not less than 0.80 wt % and a tool life of a machine tool exceeding 180 pieces or more, as an index of machinability, thus exhibiting remarkable improvement. Owing to addition of Ni and Mo, these sintered materials have a tensile strength after bright hardening, as high as 720 to 1,050 MPa, and hence high strength. Sizing is also possible as sintered. In contrast, in sintered material No. 3-7 wherein the amounts of B-containing compound powder departed from the scope of the invention, compressibility reduced though machinability did not so much lower. Sintered material No. 3-6 wherein B-containing compound powders were absent, sintered material No. 3-8 wherein the content of S was too small and sintered material No. 3-9 wherein the content of Mn was too large were all insufficient in free graphite and had extremely low machinability and were not adaptable to sizing. Sintered materials No. 3-10 and No. 3-11 in which the amounts of alloys were too large were all poor in machinability, and were unadaptable to sizing.

When comparison was made between sintered materials No. 3-3, No. 3-12 and No. 3-13 in which the same components were added in the same amounts, but wherein different mixing methods were employed, sintered materials No. 3-12 and No. 3-13 treated to be free of segregation revealed large amounts of free graphite and hence high machinability as compared to sintered material No. 3-3. Sintered materials having MnS powder contained therein (No. 3-16 and No. 3-17) showed prolonged tool life of a machine tool in contrast to sintered material No. 3-1, this meaning that addition of the MnS powder leads to further improved machinability.

Example 4

An atomized iron powder was prepared which was formulated to contain S and Mn as shown in Table 4 and used as a starting powder.

Firstly, molten steel adjusted to have a given composition was atomized with water into powdered form. After being dried in a nitrogen atmosphere at 140 ° C. for 60 minutes, the resulting powder was subjected to reduction treatment in an all-hydrogen atmosphere at 930° C. for 20 minutes. On cooling, the powder thus treated was taken out of the reducing oven, pulverized and classified to provide an atomized iron powder as the starting powder.

The starting powder obtained above was mixed with a carbonyl Ni powder, an Mo trioxide powder and a Cu powder to have a composition tabulated in Table 4. The resulting mixture was annealed in hydrogen gas at 875° C. for 60 minutes with the result that those alloying component powders were caused to diffusively attach to the starting powder on its surface, whereby partially alloyed steel powders were obtained. Here, the contents of Ni, Cu and Mo shown in Table 4 are by weight percentage in the iron powder.

The alloy steel powder was mixed with one or more B-containing compound powders in those amounts tabulated in Table 4, 1.5 wt % of a graphite powder and a lubricant. Mixing was performed with use of the mixing methods 1A to 5A shown in Example 2, whereby powder mixtures were provided. Here, the amount of each B-containing compound powder and graphite powder to be added is expressed by weight percentage based on the total amount of the iron powder, B-containing compound powder and graphite powder.

These powder mixtures were pressed to form green compacts. In Table 5, the amounts of one or more B containing compounds powders are shown as B content in B containing compound powders.

The amount of free graphite and the sliding properties were evaluated by use of a cylindrical test specimen of 10 mm ϕ in inner diameter, 20 mm ϕ in outer diameter and 8 mm in height resulting from a sintered material produced as mentioned above. A shaft made of S45C was inserted circumferentially of the test specimen with a clearance of 20 μm with respect to the porous wall of the test specimen. Wear resistance testing was done by causing the shaft to rotate at a circumferential speed of 100 m/min under dry conditions and by increasing contact load stepwise from a low load. The sliding property of the sintered material was determined by the contact load required for the shaft and the inner circumferential wall of the test specimen to stick. The better sliding property is exhibited when the contact load is at a higher level when sticking first occurs.

The results obtained are shown in Table 4.

TABLE 4

| Sintered material No. | Composition of iron powder (wt %) S | Mn | Ni | Cu | Mo | Composition of mixed powder (wt %) B compound powder (expressed as B) $H_3BO_3$ | $B_2O_3$ | Ammonium borate | BN | Mixing method | Sintered material Amount of free graphite wt % | Sliding property kgf/cm$^2$ | Remarks |
|---|---|---|---|---|---|---|---|---|---|---|---|---|---|
| 4-1 | 0.08 | 0.15 | 4.00 | 0.50 | 1.50 | 0.12 | — | — | 0.02 | 1A | 1.20 | 7.0 | Invention ex. |
| 4-2 | 0.12 | 0.10 | 2.00 | 1.00 | 1.50 | 0.20 | — | — | — | 1A | 1.20 | 6.0 | Invention ex. |
| 4-3 | 0.14 | 0.08 | 3.00 | 0.50 | 1.00 | — | — | 0.08 | — | 1A | 1.10 | 6.0 | Invention ex. |
| 4-4 | 0.08 | 0.10 | 4.00 | 0.50 | 1.50 | — | — | — | — | 1A | 0.06 | 0.2 | Comparative ex. |
| 4-5 | 0.02 | 0.06 | 4.00 | 0.50 | 1.50 | 0.05 | — | — | — | 1A | 0.02 | 0.3 | Comparative ex. |
| 4-6 | 0.08 | 0.43 | 4.00 | 0.50 | 1.50 | 0.12 | — | — | — | 1A | 0.30 | 0.2 | Comparative ex. |
| 4-7 | 0.10 | 0.09 | 4.00 | 2.00 | 1.50 | — | 0.10 | — | — | 2A | 1.30 | 6.2 | Invention ex. |
| 4-8 | 0.09 | 0.10 | 2.00 | 2.00 | 0.50 | 0.08 | — | — | — | 3A | 1.32 | 8.0 | Invention ex. |
| 4-9 | 0.15 | 0.20 | 4.00 | 2.00 | 1.50 | — | — | — | 0.10 | 4A | 1.35 | 8.0 | Invention ex. |
| 4-10 | 0.20 | 0.08 | 2.00 | 2.00 | 0.50 | 0.12 | — | — | — | 5A | 1.32 | 8.0 | Invention ex. |
| 4-11 | 0.08 | 0.15 | 4.00 | 0.50 | 1.50 | — | — | — | 0.10 | 1A | 1.30 | 7.0 | Invention ex. |
| 4-12 | 0.15 | 0.20 | 4.00 | 1.00 | 2.00 | — | — | — | 0.15 | 1A | 1.30 | 7.2 | Invention ex. |

As is evident from Table 4, sintered materials (No. 4-1 to No. 4-3 and No. 4-7 to No. 4-12) resulting from use of the iron based powder mixtures for powder metallurgy according to the present invention contain free graphite in amounts of not less than 1.1 wt % and have a contact load as high as 6 kgf/mm$^2$. Amounts of free graphite of 1 wt % or over produce a conspicuous enhancement in sliding property. All of sintered material No. 4-4 wherein B-containing compound powders were absent, sintered material No. 4-5 wherein the content of S was too small and sintered material No. 4-6 wherein the content of Mn was too large were insufficient in free graphite and low in sliding property. Sintered materials No. 4-7 to No. 4-10 treated to be free of segregation revealed increased amounts of free graphite and hence improved sliding property.

As described and shown hereinabove, the present invention offers a sintered material having excellent machinability and sliding property as compared to that resulting from use of a conventional iron powder or powder mixture. Machine parts produced from the sintered material of the invention are high in dimensional accuracy and long in tool life, and hence, the invention is significantly industrially useful.

What is claimed is:

1. A mixture for powder metallurgy comprising an iron powder comprising S in a content of about 0.03 to 0.30 wt %, one or more than one B-containing compound powder, and a graphite powder, said B-containing compound powder being present in an amount of about 0.001 to 0.3 wt % expressed as B content in all of one or more B containing compounds, based upon the total amounts of all of said iron powder, said B-containing compound powder and said graphite powder.

2. A mixture according to claim 1, which further comprises a lubricant.

3. A mixture according to claim 1 or 2, which further comprises a copper powder present in an amount of up to but not more than about 4 wt %, with respect to the amounts of all of said iron powder, said B-containing compound powder, said graphite powder and said copper powder.

4. A mixture according to claim 1 or 2, which further comprises an MnS powder present in an amount of about 0.05 to 1.0 wt %, based upon the total amounts of all of said iron powder, said B-containing compound powder, said graphite powder and said MnS powder.

5. A mixture according to claim 1 or 2, which further includes a copper powder, and an MnS powder, said copper powder being present in an amount of up to but not more than about 4 wt % with respect to the amounts of all of said iron powder, said B-containing compound powder, said graphite powder, said MnS powder and said copper powder.

6. A mixture according to claim 1 or 2, wherein said iron powder is an atomized iron powder, comprising Mn in a content of about 0.05 to 0.40 wt %, and the balance Fe and incidental impurities.

7. A mixture according to claim 3, wherein said iron powder is an atomized iron powder comprising Mn in a content of about 0.05 to 0.40 wt % and the balance Fe and incidental impurities.

8. A mixture according to claim 4, wherein said iron powder is an atomized iron powder comprising Mn in a content of about 0.05 to 0.40 wt % and the balance Fe and incidental impurities.

9. A mixture according to claim 5, wherein said iron powder is an atomized iron powder comprising Mn in a content of about 0.05 to 0.40 wt % and the balance Fe and incidental impurities.

10. A mixture according to claim 1 or 2, wherein said iron powder is an atomized iron powder, comprising Mn in a content of 0.05 to 0.40 wt % and one or both of two elements selected from the group consisting of Ni in a content of about 0.5 to 7.0 wt % and Mo in a content of about 0.05 to 6.0 wt %, and the balance Fe and incidental impurities.

11. A mixture according to claim 1 or 2, wherein said iron powder is an atomized iron powder which further includes MnS powder and said MnS powder in an amount of about 0.05 to 1.0 wt %, respectively, based upon the amounts of all of said iron powder, said B-containing compound powder, said graphite and said MnS powder, Mn in a content of about 0.05 to 0.40 wt %, one or both metals selected from the group consisting of Ni in a content of about 0.5 to 7.0 wt % and Mo in a content of about 0.05 to 6.0 wt %, and the balance Fe and incidental impurities.

12. A mixture according to claim 1 or 2, wherein said iron powder is an atomized iron powder which is partially alloyed with one or more metals selected from the group consisting of Ni in a content of about 0.5 to 7.0 wt %, Cu in a content of about 0.5 to 7.0 wt % and Mo in a content of about 0.05 to 3.5 wt %, which contents are based on the total amount of all of said iron based powder mixture, and prealloyed with Mn in a content of about 0.05 to 0.40 wt %, and the balance Fe and incidental impurities.

13. A mixture according to claim 1 or 2, wherein said MnS powder being mixed in an amount of about 0.05 to 1.0 wt %, respectively, based upon the amounts of all of said iron powder, said B-containing compound powder, said graphite and said MnS powder and said iron powder is prealloyed with Mn in a content of about 0.05 to 0.40 wt % and partially alloyed with one or more metals selected from the group consisting of Ni in a content of about 0.5 to 7.0 wt %, Cu in a content of about 0.5 to 7.0 wt % and Mo in a content of about 0.05 to 3.5 wt %, and further containing as the balance Fe and incidental impurities.

14. A mixture according to claim 1 or 2, wherein said iron powder has, adhered to the surface thereof, said B-containing compound powder.

15. A mixture according to claim 1 or 2, which further comprises a copper powder, in an amount of not more than about 4 wt %, respectively, with respect to the total, said iron powder having adhered to the surface thereof said B-containing compound powder.

* * * * *

UNITED STATES PATENT AND TRADEMARK OFFICE

CERTIFICATE OF CORRECTION

PATENT NO.: 5,938,814
DATED: August 17, 1999
INVENTOR(S): Satoshi Uenosono, et al.

It is certified that error appears in the above-identified patent and that said Letters Patent is hereby corrected as shown below:

In Column 12, in Table 1, under "Remarks" (13th column), in Row No. 5 (the fifth row down), please change "Inventive" to --Comparative--.

In Column 14, in Table 1-continued, under "Remarks" (13th column), in Row No. 9 (the fourth row down), please change "Comparative" to --Inventive--.

Signed and Sealed this

Seventeenth Day of October, 2000

*Attest:*

Q. TODD DICKINSON

*Attesting Officer*

*Director of Patents and Trademarks*